United States Patent [19]

Holbrook et al.

[11] Patent Number: 4,979,730

[45] Date of Patent: Dec. 25, 1990

[54] SHEET DRIVE SYSTEM HAVING AN ENCODER APPARATUS

[75] Inventors: Russell W. Holbrook, Middlebury; Kevin J. O'Dea, Sandy Hook; Robert A. St. John, Cheshire, all of Conn.

[73] Assignee: Pitney Bowes Inc., Stamford, Conn.

[21] Appl. No.: 435,911

[22] Filed: Nov. 14, 1989

[51] Int. Cl.[5] ..... B65H 7/02

[52] U.S. Cl. ..... 271/265; 271/270; 271/273

[58] Field of Search ..... 271/265, 270, 272–274, 271/176, 314, 202, 2

[56] References Cited

U.S. PATENT DOCUMENTS

| | | | |
|---|---|---|---|
| 3,956,617 | 5/1976 | Schmidt . | |
| 4,015,701 | 4/1977 | Templeton | 271/270 X |
| 4,220,084 | 9/1980 | Maclean et al. . | |
| 4,318,540 | 3/1982 | Paananen et al. . | |
| 4,331,328 | 5/1982 | Fasig . | |
| 4,380,801 | 4/1983 | Motomura et al. . | |
| 4,451,027 | 5/1984 | Alper . | |
| 4,455,018 | 6/1984 | Colglazier et al. . | |
| 4,550,902 | 11/1985 | Godlewski | 271/273 X |
| 4,598,901 | 7/1986 | Thomas . | |
| 4,673,175 | 6/1987 | Morita . | |
| 4,753,433 | 6/1988 | Rodi et al. | 271/202 X |
| 4,825,248 | 4/1989 | Honjo et al. . | |

*Primary Examiner*—David H. Bollinger

*Attorney, Agent, or Firm*—Charles G. Parks, Jr.; David E. Pitchenik; Melvin J. Scolnick

[57] ABSTRACT

An envelope drive assembly for assuming displacement control over an envelope along a deck supported on a support assembly including a drive means for receiving the envelope traversing the deck and assuming displacement control over the envelope. The drive means has a shaft having a drive roller fixably mounted centrally around a portion of the shaft such that a radial portion of the drive roller extent into an opening in the deck. A motor drive is provided for rotating the shaft. A support member having at least one biasing roller rotatively mounted thereto is positioned radially opposite the drive roller. The support member is pivotally mounted and biased such that the biasing roller is biased against the drive roller. A processor controls the drive motor. A sensor is provided for sensing the presence of the leading and trailing edge of the envelope in the nip area of the biasing roller and drive roller and informing the processor thereof. An encoder wheel is rotatively mounted to the shaft for informing the processor of the change in displacement of the envelope in the drive means.

4 Claims, 3 Drawing Sheets

SHEET DRIVE SYSTEM HAVING AN ENCODER APPARATUS

BACKGROUND OF THE INVENTION

This invention relates to sheet drive assemblies and, more particularly, to a sheet drive assembly having an encoder wheel apparatus.

For the purpose of illustration, a mail processing system will include an envelope feed path which transports an envelope between various stations such that operations, such as, weighing, printing, sealing and the like, can be performed on the envelope. It has been found that the system can be increased by decreasing the transport distance between stations. It would be further advantageous to have the stations aligned in a linear contiguous manner such that, for example, a long envelope ejected from one station is received by the next station and processing there commenced prior to complete ejecting from the preceding station. Such a procedure enables the approximation of a continuous processing system. In addition, the throughput of mail systems can be increased by matching or optimizing the station operation speed in accordance with the optimum speed relative to the envelope size. However, obtaining such optimum conditions requires a positive control over the envelope in addition to a means of monitoring envelope true speed and position.

SUMMARY OF THE PRESENT INVENTION

It is object of the present invention to present a sheet drive means which includes a true speed and position indicator for an envelope referencing the leading edge displacement of the envelope.

A mail processing apparatus will include a deck on which an envelope is transported. The deck includes a recess through which envelope drive wheels communicate with the envelope being transported by the deck. Above the envelope drive wheels are biasing wheels for biasing the envelope against the drive wheel for providing positive drive control over the envelope.

The drive wheels are fixably mounted to a drive shaft which is in communication with a motor. An encoder wheel is rotatably mounted on the drive shaft. The encoder wheel is mounted such that a traversing envelope provides a positive friction drive force to the encoder wheel. The encoder wheel includes an activation ring located opposite encoding sensors. The speed at which the encoder is driven by a traversing envelope and, hence, activation of the encoding sensor by the activation ring is relatable to the linear speed and position of the envelope. Located above the respective drive wheels and encoder wheel are biasing wheels which are mounted to an assembly to exert a downward bias force on an envelope position between the biasing wheels and the respective drive wheel and encoder wheel. A position sensor is located along the nip area between the biasing wheels and the drive wheel and encoder wheel. An envelope which is received in the nip area activates the nip sensor which informs a microprocessor motor controller to commence a control cycle.

DETAILED DESCRIPTION OF THE PREFERRED EMBODIMENT

Figure 1:
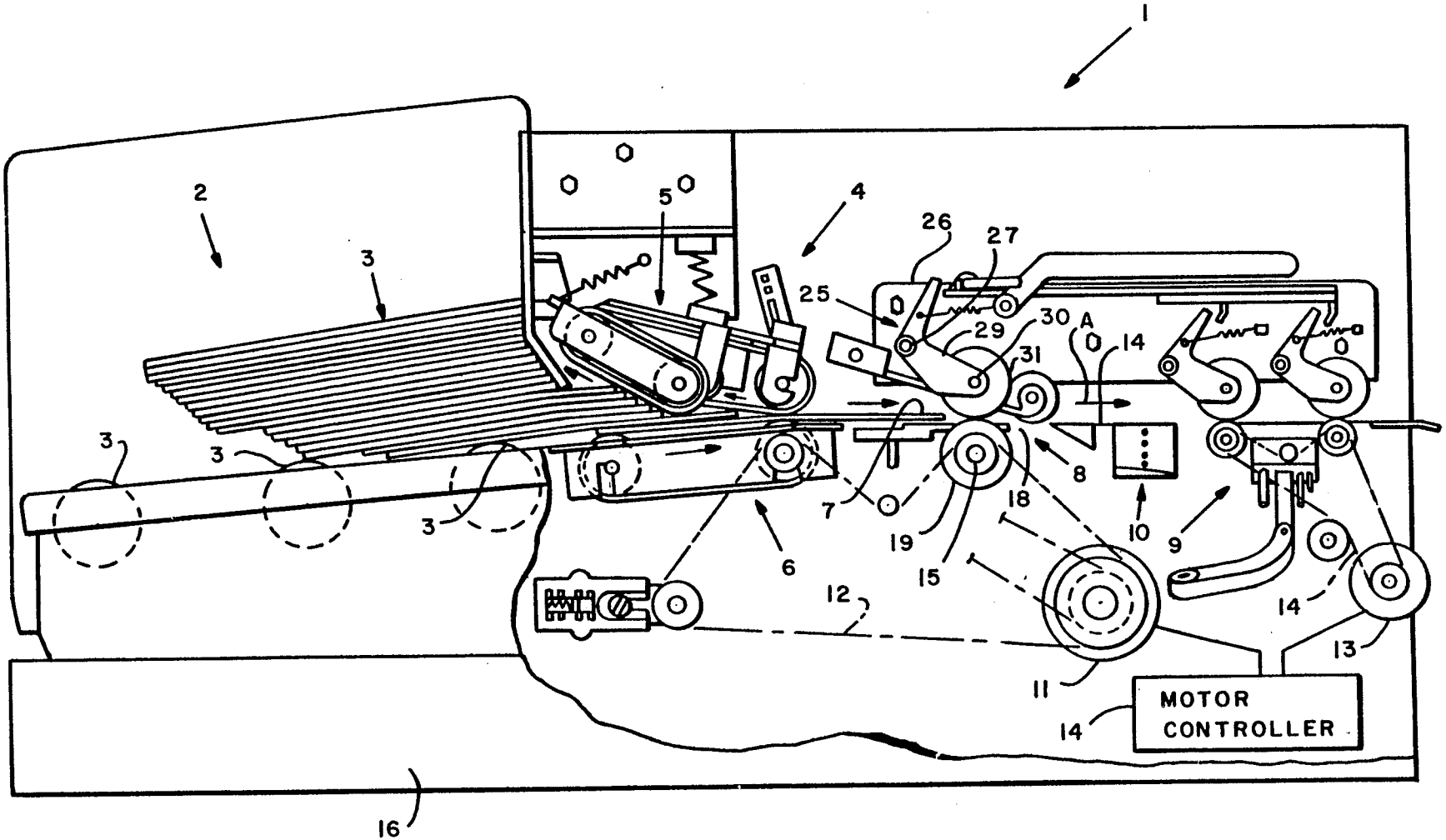
FIG. 1 is a side view of an envelope feeder employing a drive and encoder assembly in accordance with the present invention.

Referring to FIG. 1, an envelope feeder, generally indicated as 1, includes an envelope separator station 2 for receiving an envelope stack 3. At the separator station 2, the bottom most envelopes are caused by driven rollers 3 to be received by a singulation station 4. The singulation station 4 is generally comprised of reverse driven belt assembly 5 and forward driven belt assembly 6, both assemblies of any suitable construction. From the separator station 2, the bottom most envelope 7 is received by a flap separation station 8 followed by a flap moistening station 9.

Generally, the flap separation station 8 is comprised of a suitable mechanism to position selected envelope 7 flap to pass over a sensor bank 10 prior to having moisture applied to the envelope queue line at moistener station 9.

A single motor 11 is in endless belt 12 communication with the belt assembly 6 and flap separation station 8. A second motor 13 is in endless belt 14 communication with the moistener station 9. The separation between successive feeder stations 2, 4 8 or 9 is less than the length of the smallest envelope processable by the feeder 2. The motors 11 and 13 are under the control of a programmable microprocessor 14 suitably programmed such that the drive belt assembly 6 is driven at a first speed ($S_1$) until the leading of the envelope 7 is received in the flap separator station 8 whereafter the drive belt assembly 6 is driven by the motor 11 at a speed ($S_2$) best suited to the separator station 8. As the leading edge of the envelope 7 is received by the moistener station 9, the motors 11 and 13 are driven by the controller 14 at a complimentary speed $S_3$ and $S_4$, respectively, such that the envelope 7 while under the influence of both motors 11 and 13 is driven at a constant speed.

Figure 2:
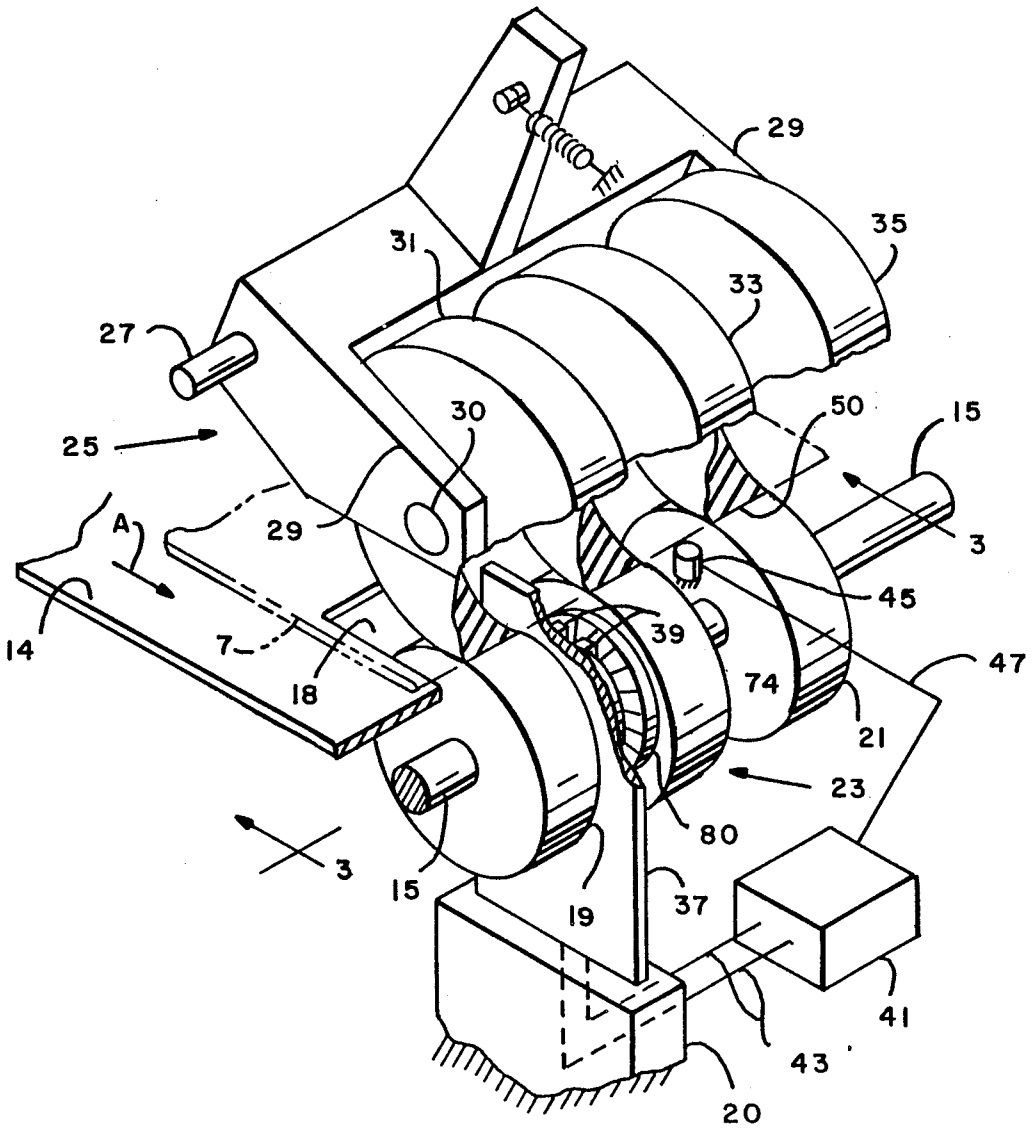
FIG. 2 is an exploited view of the drive and encoder assembly in accordance with the present invention.

Referring more particularly to the FIGS. 1 and 2, the feed deck 14 provides a transport surface for an envelope 7 in the direction of arrow A. The deck 14 is a suitable support structure (not shown) by the base 16 of the feeder 1 in a conventional manner. At station 8, the deck 14 includes an opening 18. A shaft 15 is in driven by belt 12 communicating with the motor 11 in a conventional manner. A drive wheel 19 and a second drive wheel 21 are fixably mounted to respective portions of shaft 15 in axial spaced apart relationship. A portion of each drive wheel 19 and 21 partially extends through a deck opening 18. Rotatively mounted around a respective portion of the shaft 15 between drive wheels 19 and 21, in a manner subsequently described, is an encoder wheel assembly 23 which also partially extends through the deck opening 18.

A support member 25 is pivotally mounted around a shaft 27 fixed at one end to the support wall 26 of the feeder 1. The support member 25 includes support arms 29 which have a wheel shaft 30 fixably mounted therebetween. Rotatably mounted on the wheel shaft 30, by any conventional means, are biasing wheels 31, 33, and 35. The biasing wheels 31, 33, and 35 are aligned opposite to respective wheels 19, 23 and 21.

A circuit board 37 is fixably mounted at one end to a base support post 20. The circuit board 37 extends to one side of the encoder wheel 23. A portion of shaft 15 extends through the board 37 in a manner subsequently described. The board 37 has mounted thereto sensors 39 located opposite the encoder wheel 23. The IC board contains suitable electronics for processing the sensors 39 information and communicates the sensors 39 information to a microprocessor 41 through lines 43. An optical sensor 45 is also mounted to the base support structure in a conventional manner, such that, the sensor 45 is activated by an envelope 7 when the leading edge of the envelope 7 enters the wheel nip area 50. As aforenoted, station 8, in the preferred environment of the present invention, further includes a suitable flap separation apparatus (not shown). A description of a suitable apparatus can be found in U.S. patent application Ser. No. 291,097.

Figure 3:
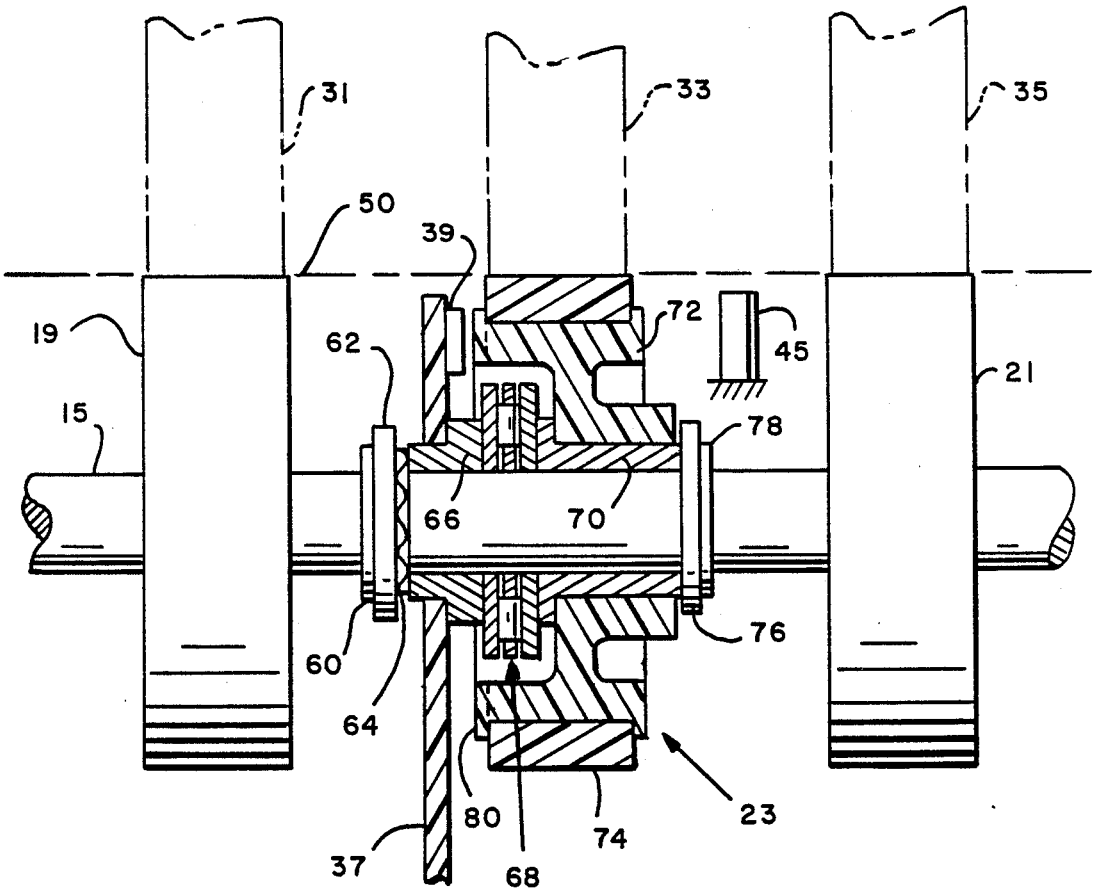
FIG. 3 is a partial sectioned elevated view of the drive and encoder assembly in accordance with the present invention.

The encoder wheel 23 as viewed in FIG. 3 will be described from left most component to right. A C-clamp 60 is fixably mounted axially in a conventional manner around the shaft 15, followed by a ring washer 62 and a wave washer 64. A bearing 66 is mounted around the shaft 15 having a portion which extends through the board 37. A conventional thruster bearing assembly 68 is then mounted around the shaft 15 followed by a bearing 70 and washer 76 and C-clamp 78. An encoder wheel hub 72 is mounted around the bearing hub of bearing 70 such that the encoder wheel hub 72 is free to rotate about the shaft 15. A wheel 74 is then mounted around the encoder wheel hub 72. The encoder wheel hub also includes the sensor activation ring 80.

The activation ring 80 is comprised of a plurality of magnetic elements of alternating polarities opposite the sensors 39 such that a repeating two-by-four (2×4) sensor matrix is created upon rotation of the encoder wheel. It can now be appreciated that the time variations of the actuation of the sensors 39 will give a true velocity reading of the envelope as it passes over the encoder wheel 23.

It is noted that the motor controller 14 is programmed to optimize the through speed of a envelope 7 as it traverses the various stations 6, 8, and 9 as a function of a variety of envelope parameters and feed operation modes, for example, sealing or non-sealing mix parameter mail, etc. As a result, the speed at which an envelope 7 is caused to traverse the feeder 1 is continually varied. To prevent binding and assure proper operation of the feeder system, the encoder wheel 23, in combination with the sensor 39, provide the motor controller 14 a means of determining the envelopes true speed and position such that necessary speed adjustments may be made to motors 11 and 13 and true position and speed be communicated to active sealing apparatus in order to track the flap gumline.

What is claimed is:

1. A sheet drive assembly for assuming displacement control over a sheet material traversing along a deck supported by a support structure, comprising:

a drive means for receiving said sheet material and assuming control over said sheet material there through, said drive means having a shaft having at least one drive roller fixably mounted centrally around a portion of said shaft such that a radial portion of said drive roller extent into said opening in said deck, motor drive means for rotatively driving said shaft, a force against support means having at least one biasing roller rotatively mounted thereto for supporting said biasing roller radially opposite said drive roller, and means for biasing said support means such that said biasing roller is biased against said drive roller, said support means being pivotally mounted to said support structure such that said biasing roller may be displace in a arched manner by the presence of said sheet material between said drive roller and said biasing roller;

a processor means for controlling said drive means;

a sensor means for sensing the presence of the leading and trailing edge of said sheet material when received between said biasing roller and said drive roller and informing said processor thereof; and, an encoder means for informing said processor of the change in displacement of said sheet material in said drive means;

said encoder means an encoder wheel rotatively mounted centrally around a portion of said shaft such that a radial portion of said encoder wheel extends into said opening in said deck, said encoder wheel having an actuation ring fixably mounted to one side face of said encoder wheel, sensing means fixably mounted to said support structure and aligned opposite said encoding means for sensing the radial displacement of said actuation ring, an encoder biasing wheel rotatively mounted to said support means radially opposite said encoder wheel such that said encoder wheel is caused to rotate at a speed directly related to the speed at which said sheet material passes there between.

2. An envelope drive assembly for assuming displacement control over an envelope transported along a deck supported by a support structure, comprising:

a drive means for receiving an envelope traversing said deck and assuming control over said envelope, said drive means having a shaft, at least one drive roller fixably mounted centrally around a portion of said shaft such that a radial portion of said drive roller extent into an opening in said deck and motor drive means for rotatively driving said shaft, a support means having at least one biasing roller rotatively mounted to said support means for supporting said biasing roller radially opposite said drive roller and means for biasing said support means such that said biasing roller is biased against said drive roller, said support means being pivotally mounted to said support structure such that said biasing roller may be displace in an arched manner by said envelope located between said drive roller and said biasing roller;

a processor means for controlling said drive means;

a sensor means for sensing the presence of the leading and trailing edge of said envelope when received between said drive roller and said biasing roller and informing said processor thereof; and, an encoder means for informing said processor of the change in displacement of said envelope in said drive means, said encoder means having an encoder wheel rotatively mounted centrally around a portion of said shaft such that a radial portion of said encoder wheel extends into the opening in said deck, said encoder wheel having an actuation ring fixably mounted to one side face of said encoder wheel, sensing means fixably mounted to said base and aligned axially said encoding means for sensing the radial displacement of said actuation ring, and an encoder biasing wheel rotatively mounted to said support means radially opposite said encoder wheel such that said encoder wheel is caused to rotate at a speed directly related to the speed at which said envelope passes said encoder wheel and said encoder biasing wheel.

3. An envelope drive assembly as claimed in claim 2, wherein said actuation ring is comprised of a plurality of magnetic element of alternating polarity.

4. An envelope drive assembly as claimed in claim 3 wherein said sensing means comprises a plurality of magnetically responsive sensors.

* * * * *